US007533067B2

(12) United States Patent
Beckstrom et al.

(10) Patent No.: US 7,533,067 B2
(45) Date of Patent: May 12, 2009

(54) CONTROL PANEL LABEL FOR A POSTAGE PRINTING DEVICE

(75) Inventors: David W. Beckstrom, Milford, CT (US); Steven M. Kaye, Weston, CT (US); Benjamin Singer, Bridgeport, CT (US)

(73) Assignee: Pitney Bowes Inc., Stamford, CT (US)

( * ) Notice: Subject to any disclaimer, the term of this patent is extended or adjusted under 35 U.S.C. 154(b) by 652 days.

(21) Appl. No.: 11/172,182

(22) Filed: Jun. 30, 2005

(65) Prior Publication Data

US 2007/0005518 A1 Jan. 4, 2007

(51) Int. Cl.
*G07B 17/02* (2006.01)
*G07B 17/00* (2006.01)

(52) U.S. Cl. ..... 705/402; 705/401; 705/406; 705/408; 705/410; 400/621; 400/578; 355/40

(58) Field of Classification Search ..... 705/410, 705/408; 382/101; 400/76, 621; 358/453; 156/64; 715/764; 355/40
See application file for complete search history.

(56) References Cited

U.S. PATENT DOCUMENTS

| | | | | |
|---|---|---|---|---|
| 4,908,853 | A | 3/1990 | Matsumoto | 379/355 |
| 5,199,063 | A | 3/1993 | Erickson et al. | 379/100 |
| 5,539,530 | A | 7/1996 | Reifman et al. | 358/402 |
| 5,717,597 | A * | 2/1998 | Kara | 705/408 |
| 5,781,619 | A | 7/1998 | Kong | 379/100.14 |
| 5,784,009 | A | 7/1998 | Wada et al. | 341/23 |
| 5,798,848 | A | 8/1998 | Ouchi | 358/468 |

(Continued)

FOREIGN PATENT DOCUMENTS

EP 0 090 630 A2 10/1983

(Continued)

OTHER PUBLICATIONS

F104 Facsimile Operating Instructions, pp. I, ii and 67-70, 6 pages, date unknown, accessed Jun. 28, 2005 from http://www.lanier.com/pdf/lf410_basic.pdf.

*Primary Examiner*—John W Hayes
*Assistant Examiner*—Brian Epstein
(74) *Attorney, Agent, or Firm*—George M. Macdonald; Steven J. Shapiro; Angelo N. Chaclas

(57) ABSTRACT

Systems and methods for providing a locally printed replaceable control panel labels for providing an economical user interface to a postage printing device using a collocated processor are described. In one configuration, a remote data center provides Units of Information of Value UIVs of distinct denominations such as postage indicia to a Virtual Stamp Dispensing Metering VSDM printer. Custom graphic images are also processed for use and stored at the collocated processor for selective transfer to the VSDM. Using the collocated PC, the user selects certain denominations to be assigned to denomination buttons on the VSDM. Similarly, the user selects certain custom images to be associated with custom image buttons on the VSDM. The system then prints a replaceable control panel button label using the VSDM printer having zones associated with each button for printing thumbnails of the custom images and denomination icons for the selected virtual stamp denominations. The user then inserts the replaceable custom control panel label in the VSDM control panel recess under the hinged control panel window.

9 Claims, 5 Drawing Sheets

U.S. PATENT DOCUMENTS

| | | | | |
|---|---|---|---|---|
| 5,923,406 | A * | 7/1999 | Brasington et al. | 355/40 |
| 6,068,716 | A * | 5/2000 | Higgins | 156/64 |
| 6,151,133 | A | 11/2000 | Sakauchi et al. | 358/1.15 |
| 6,292,271 | B1 | 9/2001 | Phan | 358/440 |
| 6,483,906 | B1 | 11/2002 | Iggulden et al. | 379/102.03 |
| 6,594,374 | B1 * | 7/2003 | Beckstrom et al. | 382/101 |
| 6,648,533 | B2 * | 11/2003 | Lo et al. | 400/621 |
| 6,882,712 | B1 | 4/2005 | Iggulden et al. | 379/102.03 |
| 7,194,957 | B1 * | 3/2007 | Leon et al. | 101/485 |
| 2003/0004901 | A1 * | 1/2003 | Dutta et al. | 705/402 |
| 2003/0074325 | A1 | 4/2003 | Ryan, Jr. | 705/60 |
| 2003/0140017 | A1 * | 7/2003 | Patton et al. | 705/410 |
| 2003/0143012 | A1 * | 7/2003 | Block | 400/615.2 |
| 2004/0207885 | A1 * | 10/2004 | Jackson et al. | 358/453 |
| 2004/0254898 | A1 * | 12/2004 | Parker et al. | 705/402 |
| 2005/0071297 | A1 * | 3/2005 | Kara | 705/410 |
| 2005/0080751 | A1 * | 4/2005 | Burningham | 705/401 |
| 2005/0117949 | A1 * | 6/2005 | Waldal | 400/76 |
| 2006/0005141 | A1 * | 1/2006 | Buil et al. | 715/764 |
| 2006/0259444 | A1 * | 11/2006 | Obrea et al. | 705/401 |

FOREIGN PATENT DOCUMENTS

| | | | |
|---|---|---|---|
| EP | 0 586 333 | A2 | 4/1992 |
| EP | 0 497 036 | A2 | 5/1992 |
| EP | 0 908 852 | A2 | 4/1999 |

* cited by examiner

CONTROL PANEL LABEL FOR A POSTAGE PRINTING DEVICE

FIELD OF THE INVENTION

The present invention relates to a system and method for providing a user interface for a value printing device and more particularly in certain embodiments to a system and method for providing a locally printed replaceable control panel label for a postage printing device using a collocated processor.

BACKGROUND OF THE INVENTION

Mailing machines including postage metering systems are known in the art including the DM SERIES of mailing machines available from Pitney Bowes Inc. of Stamford, Conn. Additionally, Internet based postage delivery systems and data center services are also available from Pitney Bowes Inc. A postage metering system applies evidence of postage, commonly referred to as postal indicia, to an envelope or other mailpiece (directly or on a label to be applied thereto) and accounts for the value of the postage dispensed. Postage metering systems are often categorized as closed system meters or open system meters. In a closed system, the system functionality is typically dedicated to postage metering activity and often includes a dedicated printer securely coupled to a Postal Security Device PSD postage vault. In an open system, the printer is typically not dedicated to the metering activity and is often connected to a remote Postal Security Device PSD postage vault or virtual PSD. In the open system defined by the United States Postal Service (USPS) Information Based Indicia Program (IBIP), indicia printed by the non-dedicated printer are made secure by including elements of addressee information in the encrypted evidence of postage printed on the mailpiece for subsequent verification.

A method and system for dispensing virtual stamps is described in U.S. Patent Application Publication US 2003/0074325 A1 entitled Method and System for dispensing Virtual Stamps by Ryan that was published on Apr. 17, 2003 (the Ryan '325 Application) and that is incorporated herein by reference. A Virtual Stamp Dispensing Metering VSDM system is described wherein indicia of varying values are calculated at a remote data center and downloaded to a mailing machine. The VSDM system stores the indicia and dispenses the indicia as needed. The system includes a secure storage unit and a state indicator that is used to prevent fraudulent reuse of the virtual stamps. A status field for each indicium record, i.e., Issued or Unused, is maintained to indicate whether an indicium has been issued (printed) or not. Traditional mailing machines and postage meters include a robust user interface with a comprehensive LCD or LED information display and keypad that may be relatively complex and costly. It may not be desirable to utilize a virtual stamp postage printing device with an embedded complex user interface.

In different fields of art, certain devices have been described for providing templates for keypads such as one key dial directories used with facsimile machines. For example, in U.S. Pat. No. 5,781,619 to Kong, a method of automatically printing out rapid key labels for a facsimile machine is described, wherein a directory is printed on specialized paper having a zone with multiple removable key labels. Furthermore, in U.S. Pat. No. 5,199,063 to Erickson, et al., a system for automatically generating telephone directory labels for facsimile devices using a separate printer for printing the directory labels is described. It may not be desirable to utilize specialized stock or a separate printer for printing template labels. Such systems print only a single list of facsimile numbers and do provide for building objects from components or managing inventories.

Accordingly, there is a need for systems and methods for providing a postage printing device with an economical user interface using a locally printed control panel label. The postage printing device uses a collocated processor wherein the collocated processor controls the device in a connected mode and stores a set of custom images for use with virtual stamps and provides a robust user interface for managing and printing virtual stamps, with or without custom images, and wherein the collocated processor can assign a subset of custom images and virtual stamp denomination to postage printing device buttons and print a corresponding control panel label for the device for use in a standalone mode. Additionally, there is a need for systems and methods for providing a locally printed control panel label for a postage printing device using the postage printing device to print the control panel label on a single label using the same virtual stamp label stock used to print virtual stamps. Furthermore, there is a need for systems and methods for providing a locally printed control panel label for a postage printing device wherein a collocated processor is utilized to print the control panel label. Additionally, there is a need for systems and methods for providing a locally printed control panel label for a postage printing device wherein a combination of button strokes cause a virtual stamp value token and associated custom image to be selected and printed as a virtual stamp while another set of key strokes cause a virtual stamp token inventory label to be printed.

SUMMARY OF THE INVENTION

The present application describes illustrative embodiments of an invention relating to a system for providing a user interface for a value printing device and in certain embodiments to a system and method for providing a locally printed replaceable control panel label for a postage printing device using a collocated processor (PC). In an illustrative embodiment, a remote data center provides Units of Information of Value UIVs of distinct denominations, such as postage indicia to a Virtual Stamp Dispensing Metering VSDM printer. Custom graphic images are also processed for use and stored at the collocated processor for selective transfer to the VSDM. Using the collocated PC, the user selects certain denominations to be assigned to denomination buttons on the VSDM. Similarly, the user selects certain custom images to be associated with custom image buttons on the VSDM. The system then prints a replaceable control panel button label using the VSDM printer having zones associated with each button for printing thumbnails of the custom images and denomination icons for the selected virtual stamp denominations. The user then inserts the replaceable custom control panel label in the VSDM control panel recess under the hinged control panel window.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DESCRIPTION OF THE PREFERRED EMBODIMENTS

The illustrative embodiments of the present application describe systems and methods for providing a user interface for a value printing device and in certain embodiments to a system and method for providing a locally printed replaceable control panel label for a postage printing device using a collocated processor. A representative embodiment provides a reduced cost user interface for a postage printing device using the printer of the postage printing device and a more robust user interface of a collocated Personal Computer (PC).

In an illustrative embodiment, the VSDM printer is a stand alone thermal label printer capable of printing custom virtual stamps, including IBI indicia and images in variable denominations with user defined custom graphic images that are associated with the individual virtual stamps at the time of printing. The illustrative VSDM user interface includes five selection buttons lit with LEDs surrounding a control panel window and recess that receives a control panel label.

The user interface also includes a print/power button and LED indicator. The control panel label is printed by the VSDM printer under control of a program running on a collocated Personal Computer (PC) connected to the VSDM printer by a USB connection. The control panel label is printed on the same label stock that is used by the VSDM to print virtual stamps. The control panel label has five zones corresponding to the five selection buttons. When the control panel label is fitted into the control panel recess under the hinged control panel window, each of the zones is in close proximity to its corresponding button. The selection buttons and control panel icons permit selection of virtual stamp denominations and optionally associated custom images to be printed along side the virtual stamp indicia. The user may use the PC application to change the button association and then to print a new control panel label.

The illustrative embodiments describe a postage evidencing system for printing virtual stamp indicia and custom images and may incorporate the methods and systems for dispensing virtual stamps described in the Ryan '325 application. Similarly, the embodiments described herein may be utilized with various value printing devices such as mailing machines and postage meters available from Pitney Bowes Inc. of Stamford Conn. Additionally, commonly owned co-pending U.S. patent application Ser. No. 11/142,618 entitled System and Method for Reliable Transfer of Virtual Stamps filed May 31, 2005 by Obrea, et al. describes systems that may be utilized, and is incorporated herein by reference. Furthermore, commonly owned co-pending U.S. patent application Ser. No. 11/142,619 entitled Method to control the Use of Custom Images filed May 31, 2005 by Obrea, et al. describes systems that may also be utilized, and is incorporated herein by reference.

Figure 1:
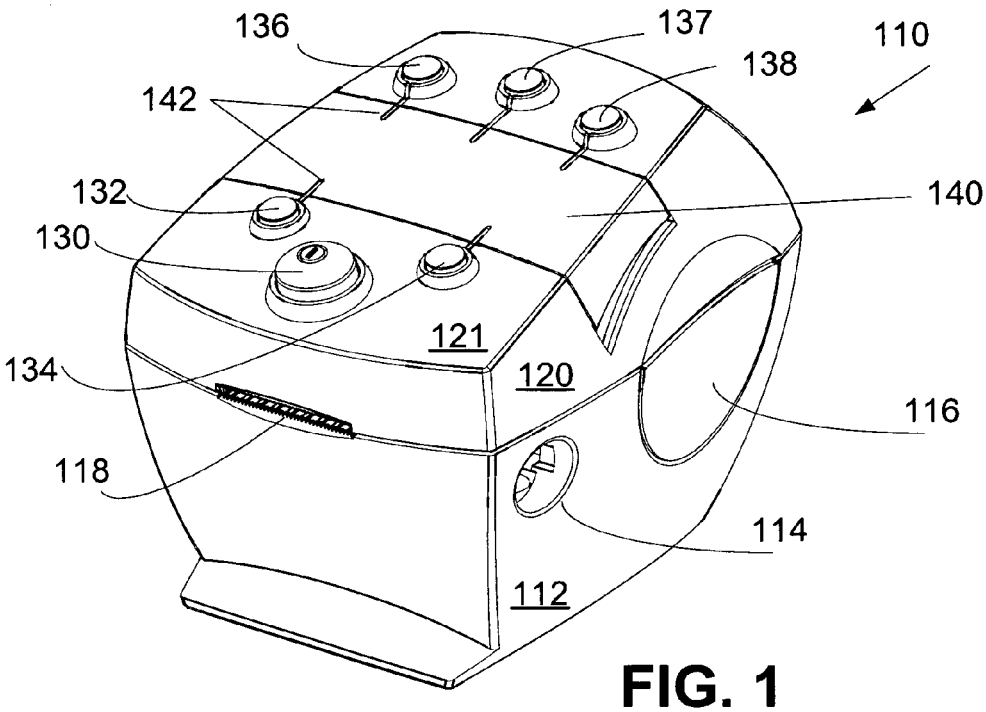
FIG. 1 is a perspective view of a virtual stamp printer according to an illustrative embodiment of a postage evidencing system according to the present application.

Referring to FIG. 1, a perspective view of a virtual stamp printer 10 according to an illustrative embodiment of the present application is shown. FIG. 1 shows portions of a virtual stamp dispensing meter 110 including a thermal printer and secure indicia accounting mechanism to keep track of printed virtual stamps.

The VSDM printer 110 includes a lower clamshell printer assembly 112 and an upper clamshell assembly 120. The upper clamshell assembly 120 includes a control panel portion 121. The clamshell portions close on a thermal media printer output port and serrated label cutting edge 118. The lower assembly 112 includes a clamshell release button assembly 114 and a translucent thermal media bay window 116. The control panel portion 121 includes a hinged translucent control panel label cover window 140 that includes several control panel markers 142. The control panel portion 121 includes six buttons/LED indicators including a row of denomination selection buttons/LED indicators 136, 137, 138 and a row of custom graphic selection buttons/LED indicators 132, 134. Additionally, the control panel portion 121 includes a print/power button/LED indicator 130.

The postage denomination selection push buttons 136, 137, 138 allow the selection of one of up to three available postage values. The custom graphic selection push buttons allow the selection of either of the installed graphic files. The user has the option to not select a custom graphic for the virtual stamp. The VSSM 110 includes a single Print button (printer state/power indicator) lit by a bi-color (Red/Green) LED to indicate the printer state. Each of the three postage denomination selection buttons (postage file state) includes a bi-color LED to indicate the quantity of that particular denomination of postage indicia files remaining. Each of the custom graphic selection push buttons includes an associated single color LED to indicate the graphic file state.

The printer state and file state indicators are used as follows in the VSDM user interface:

i. Printer State/Power Indicator bi-color (Red/Green) LED:
   1. Off indicates the printer power is off
   2. Solid Green indicates Power on, Ready to print
   3. Green Flashing indicates Power on, printing in progress
   4. Amber—Power on, less that X labels remaining on roll
   5. Solid Red—Print function locked by user
   6. Red Flashing—Printer Error
      a. If on power up it indicates a self test error
      b. If during print indicates jam or no label
      c. If at idle, indicates no label or internal error ii. Postage denomination file State bi-color LEDs
   1. Off—indicates postage denomination not selected
   2. Green—selected and more than Y remaining
   3. Amber—selected and less than Y remaining
   4. Red—value selected, but none available iii. Graphic File State LEDs 1. Illuminated—graphic file selected for print 2. Off—graphic file not selected or none assigned The values for X and Y are set as factory defaults and may be updated by the user. For example, initial values of X=5 and Y=5 may be utilized. The push button selections are assigned using a collocated PC and user interface application. When the user chooses new printer button assignments, the printer prints another control panel label to replace the previous control panel label. Only one of each type of selection button is illuminated and selected (with state indicator display) at a time. Either one or none of the graphic selection indicators may be selected. Pressing the other graphic button will select the other button and deselect the prior button. Pressing the selected button again will deselect it. If no graphic file is selected, the printer will print an indicium portion only virtual stamp. On printer power up, the left most selection buttons are selected as a default.

As described more fully below, in operation in a tethered or connected mode, a collocated processor is utilized to provide a robust user interface for the selection of virtual stamp denominations and optional custom graphic images to create and print virtual stamps using the VSDM printer 110.

Figure 5:
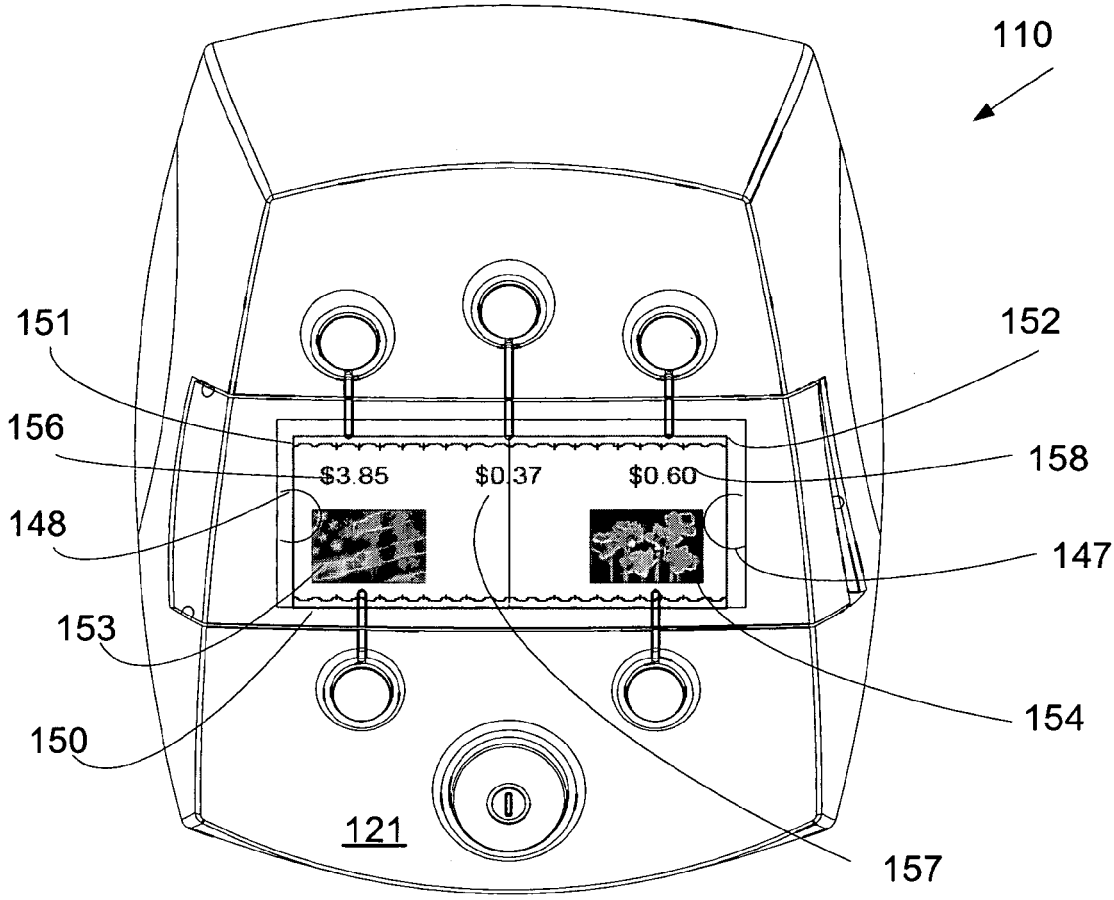
FIG. 5 is a top view of the virtual stamp printer shown in FIG. 1 including a control panel label.

As described more fully below, in operation in an untethered or standalone mode, the user selects a virtual stamp denomination using denomination selection buttons 136, 137, 138. FIG. 5 shows a more detailed view of the control panel label associated with the selection buttons. If the user selects the print button, a 1.3 inch virtual stamp indicia is printed without a custom image. If the user instead selects a custom graphic selection button before the print button, a 2.6 inch label including a 1.3 inch indicia portion and a 1.3 inch custom graphic portion is printed.

In an alternative, if the two custom graphic buttons 132, 134 are pressed simultaneously, the custom postage printer 110 prints a virtual stamp inventory listing the available denominations and the number of indicia available for each denomination. Similarly, if two of the denomination buttons are pressed simultaneously, a replacement control panel label is printed even if the printer is not connected to the companion PC. In another alternative, an ink jet printing system or other printing system such as laser printing may be utilized. In yet another alternative, the VSDM does not select the left selection buttons by default.

Figure 2:
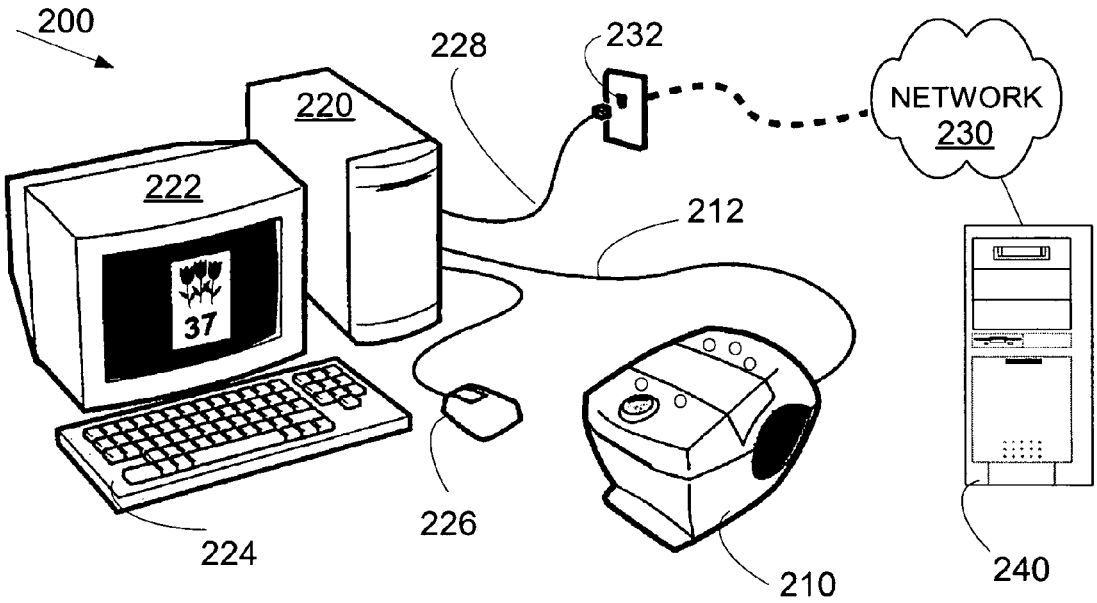
FIG. 2 is a perspective view of a virtual stamp printer system including a collocated processor according to an illustrative embodiment of a postage evidencing system according to the present application.

Referring to FIG. 2, a perspective view of a virtual stamp printer system 200 including a collocated personal computer processor PC 220 according to an illustrative embodiment of a postage evidencing system according to the present application is shown. A virtual stamp, as used herein, provides evidence of postage paid using a thermal media label that is similar to a conventional adhesive stamp. The printing hardware comprises a direct contact thermal printing subsystem and associated controller that enables the printing of virtual stamps including USPS IBIP bar codes and other near photo quality custom or stock gray scale images, but could alternatively utilize other digital printing technologies such as ribbon impact, laser jet or ink jet printing subsystems.

The system 200 includes an information of value processing device such as a Virtual Stamp Dispensing Metering VSDM system (meter) that includes a VSDM 210 and an associated co-located co-processor personal computer 220 that communicates with a Vendor Data Center 240 via network 230 and communication links 228, 232. The communication link 228, 232 comprise an Ethernet connection to the Internet, but could alternatively utilize a telephone connection via a Public Switched Telephone Network (PSTN) or a local network connection via a Local Area Network (LAN). PC 220 is connected to a display 222, keyboard 224 and a mouse 226. The VSDM 210 is connected to the PC 220 using USB serial connection 212.

VSDM 210 could be either a stand-alone postage meter, or alternatively integrated into a larger piece of equipment such as, for example, a mailing machine. In the system shown, the VSDM 210 is attached to a personal computer 220 via communications channel 212 that is a USB connection. Alternative communications channels such as a wireless channel may be used and in an alternative configuration, the VSDM 210 could communicate directly with data center 240. The VSDM 210 or the client application executing on PC 220 is used to originate requests for UIVs to be fulfilled by a data center.

Data center 240 includes a suitable processing system having a computing device such as a server computer and one or more memory components for data storage. The data center 240 also includes a Virtual Indicia system including a cryptographic subsystem and a virtual PSD record storage system that are in operative communications with the server. In an alternative embodiment, the local UIV processing system includes a personal computer with an interface to a secure smart card having a NVM state table used for processing other UIVs such as music files, video files, multimedia content UIVs or event tickets. In another alternative, the collocated processor PC 220 communicates with a remote server 240 and the collocated processor applications are hosted on server 240 and accessed using a thin client such as a browser running on PC 220.

Figure 3:
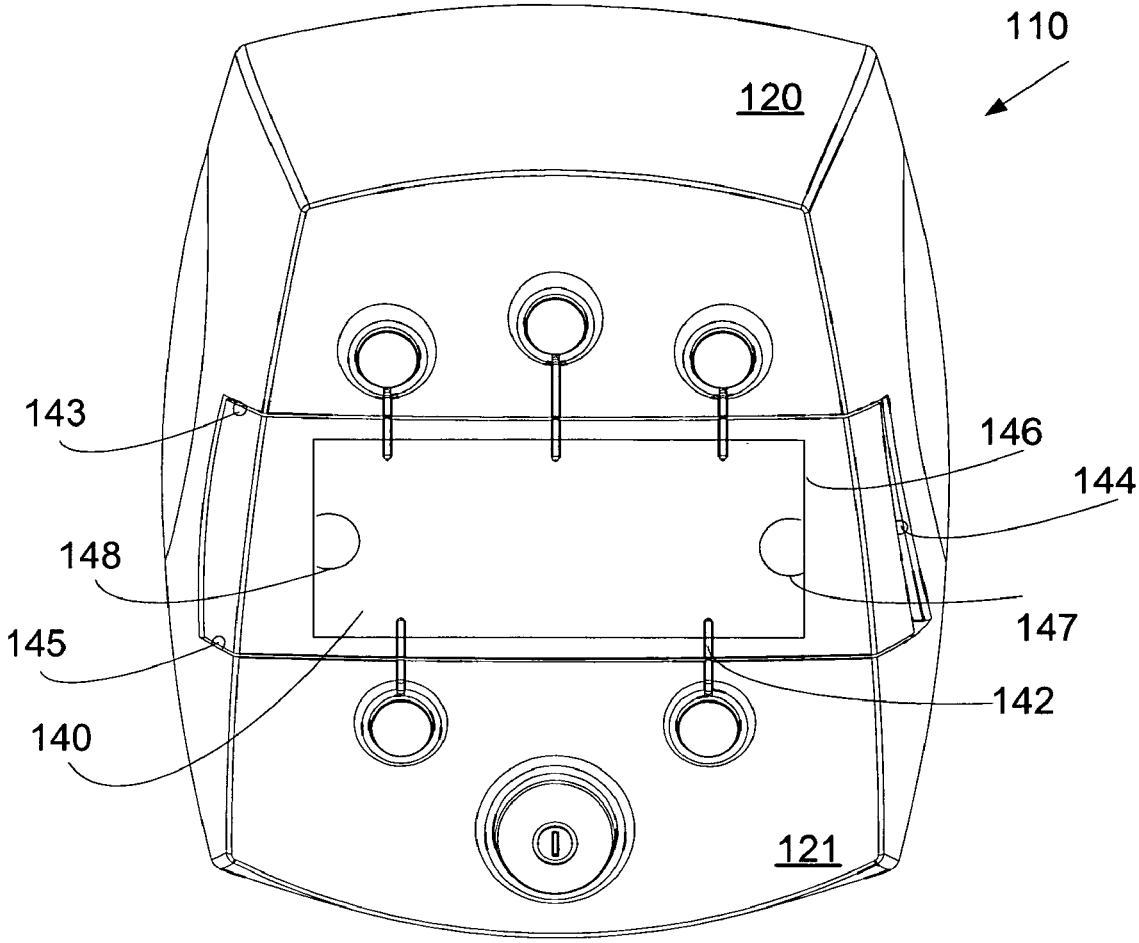
FIG. 3 is a top view of the virtual stamp printer shown in FIG. 1.

Referring to FIG. 3, a top view of the virtual stamp printer 110 of FIG. 1 is shown providing additional detail for the control panel portion 121 of the upper clamshell half 120 of the virtual stamp printer 110. Control panel portion 121 includes a hinged control panel window 140 including markings 142, hinges 143, 145 and flexible ball and socket clasp 144. The material used is preferably translucent plastic. Under the control panel window 140, the control panel portion 121 includes a control panel label recess 146 for receiving a control panel label and two tabs 147, 148 for securing the control panel label in the control panel recess 146.

Figure 4:
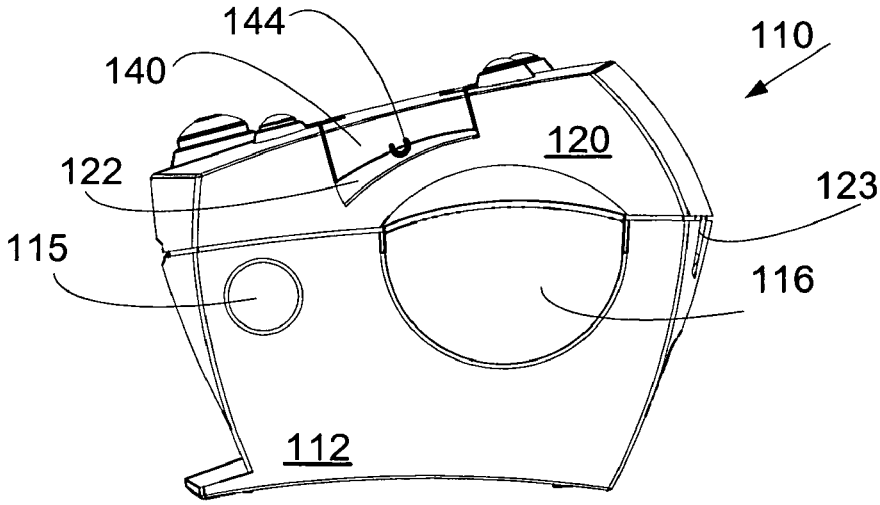
FIG. 4 is a right side view of the virtual stamp printer shown in FIG. 1.

Referring to FIG. 4, a right side view of the virtual stamp printer 110 of FIG. 1 is shown providing additional detail for the control panel portion 121 of the upper clamshell half 120 of the virtual stamp printer 110. Control panel portion 121 includes a hinged control panel window 140 including flexible ball and socket clasp 144. The upper clamshell portion 120 includes an opening 122 for gripping the window 140 so that a user can open the window to insert a control panel label. Lower clamshell portion 112 includes a clamshell release opening button 115 and translucent thermal media roll window 116. Hinge 116 attaches the upper clamshell half 120 to the lower clamshell half 112.

Referring to FIG. 5, a top view of the virtual stamp printer 110 of FIG. 1 is shown including a control panel label 150. The control panel label 150 includes two halves 151, 152. The label includes 5 zones that may be used and that are associated with the 5 denomination and custom image buttons described above. In this illustrative example, all three denomination zones 156, 157, 158 are utilized. Here, two custom image zones 153, 154 are provided that are associated with the two custom graphics selection buttons. The zones correspond to markings 142 of the control panel window 140. The control panel label 150 is placed under tabs 147 and 148 to secure the label in place. The control panel recess is slightly larger than the control panel label to accommodate the label but also maintains its position in relation to the associated buttons.

Figure 6:
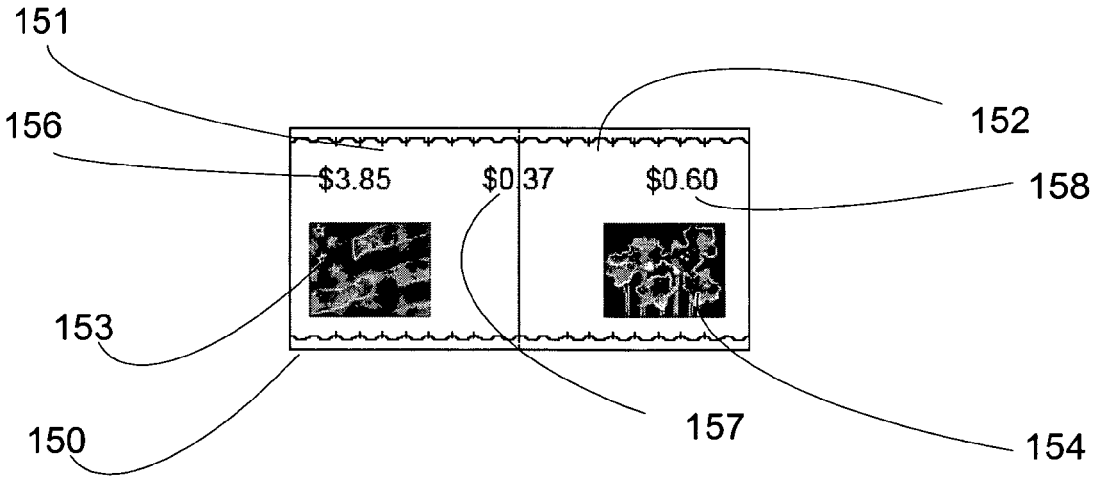
FIG. 6 is a top view of a control panel label according to an illustrative embodiment of the present application.

Referring to FIG. 6, a top view of a control panel label 150 according to an illustrative embodiment of the present application is shown. In this control label, 150, two 1.3 inch adhesive label portions 151, 152 are utilized. The control panel label used is printed on the same adhesive backed thermal media stock that is used to print the virtual stamps and custom images. In this example, the adhesive backing of the label is not removed so that the label may be easily removed and replaced from the control panel recess on the control panel portion of the upper clamshell assembly. Alternatively, the adhesive backing may be removed and the label adhered to the device if holding tabs are not present in the control panel recess or if there is no recess to insert the label. The label includes 5 zones that may be used and that are associated with the 5 denomination and custom image buttons described above. In this illustrative example, all three denomination zones are utilized. The first denomination zone 156 includes a denomination icon displaying the common $3.85 postage denomination. The second denomination zone 156 includes a denomination icon displaying the common $0.37 postage denomination. The third denomination zone 158 includes a denomination icon displaying the common $0.60 postage denomination. In an alternative, the denomination icons may include additional rate/service information such as up to one pound priority mail, 1 oz. First class letter, and so forth.

Here, two custom image zones 153, 154 are provided that are associated with the two custom graphics selection buttons. The zones 153, 154 include thumbnail representations of the selected custom images, but alternatively a file name, icon or other indicator could be utilized to reference the associated custom image. In another alternative, pre-printed and/or laminated replaceable control panel labels may be provided by the data center operator or other third party. Furthermore, an ink jet printing system may be utilized and/or a media without adhesive backing may be used.

Figure 7:
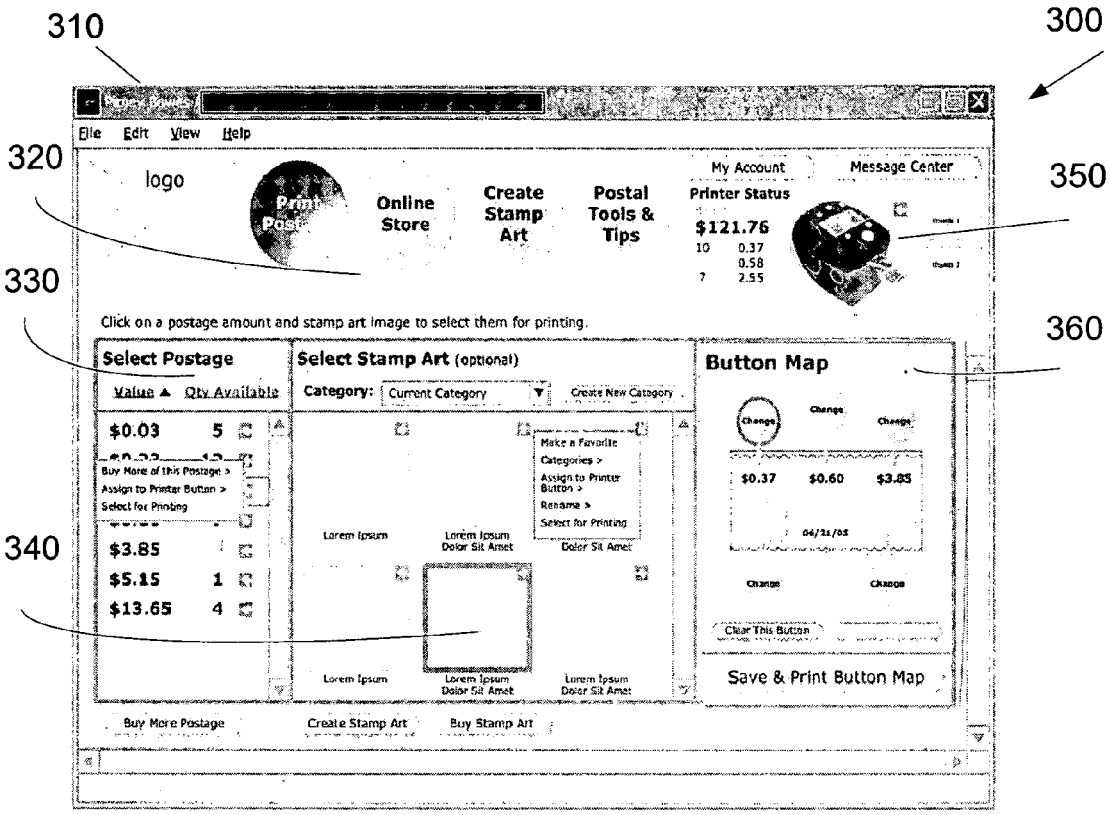
FIG. 7 is a perspective view of a screen shot of the display of a control panel label management program running on a collocated processor according to an illustrative embodiment of the present application.

Referring to FIG. 7, a perspective view of a screen shot of the display of a control panel label management program 300 running on a collocated processor 220 according to an illustrative embodiment of the present application is shown. The application 300 provides a robust user interface to the VSDM 210 when the VSDM is connected to the collocated PC 220. For example, the main function buttons 320 include the function print postage. Accordingly, when the VSDM 210 is connected to the collocated processor 220, the user does not need to use the VSDM buttons to operate the device. The user operates the device through the robust user interface program 300 such as through interactive window 310. The robust user interface 300 provides a printer status function 350 to the user. In section 330, the interface displays the postage available in the VSDM 210. The user may select a postage token of a particular value to be printed. Similarly, the user may select a custom or stock image from the stamp art collection stored on the collocated PC 220 using section 340 of the user interface. The user may then print the generated virtual stamp.

Additionally, the user interface 300 provides the facility to manage the VSDM 210 user interface for use in standalone mode. Using the control panel button map section 360, the user prepares the VSDM 210 for standalone use. The user may change the three available denominations using the upper row of buttons associated with denominations. Similarly, the user may select from a library of images stored on the collocated PC 220 to both associate the two images with the lower row of buttons and to download the images to the local storage of the VSDM 210 SO that they may be used in standalone mode.

In operation, a user sends a request to purchase postage from the meter 210 or the co-located personal computer 220 to the data center 240. Many types of requests are possible, including predefined menu choices such as the equivalent of a 20 stamp booklet or a 100 stamp roll. In response, the data center 150 generates an appropriate number of virtual stamp postage data records (one for each requested indicium) and securely transmits them (e.g., using an SSL connection) to the VSDM meter 210 or intermediary processor 220.

Figure 8:
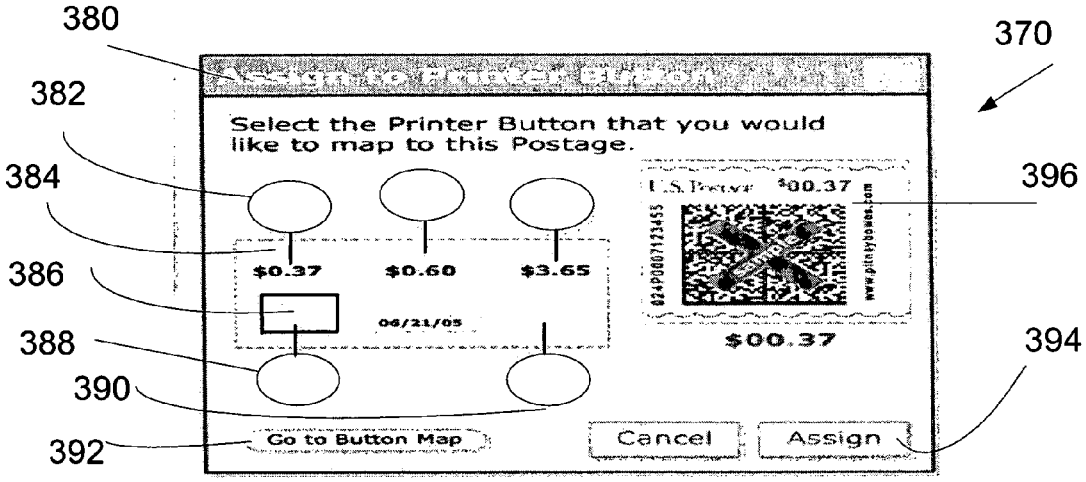
FIG. 8 is a perspective view of a screen shot of the display of a control panel label button assignment management program running on a collocated processor according to an illustrative embodiment of the present application.

Referring to FIG. 8, a perspective view of a screen shot of the display of a control panel label button assignment management program 370 running on a collocated processor 220 according to an illustrative embodiment of the present application is shown. Interactive user interface window 380 presents a representation of the control panel label so that a user may assign particular denominations or images to the appropriate buttons. The user selects a denomination 396 and may assign it to denomination button 382 using the assign button 394 and can go back to the button map using button 392. A related icon 384 displays the denomination. Similarly users may assign images to buttons 388 and 390. In that case a thumbnail of the image 386 is displayed for printing on a control label.

Figure 9:
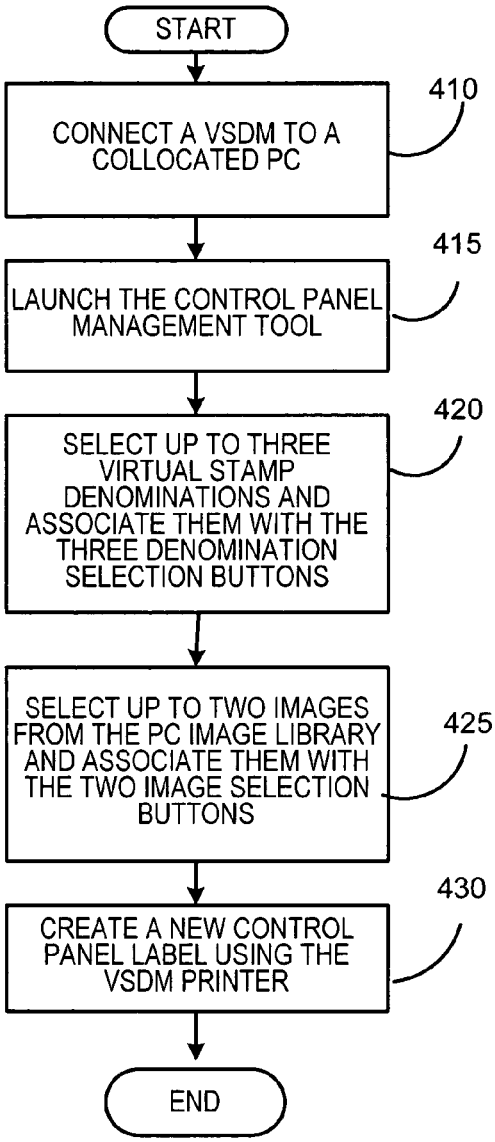
FIG. 9 is a flow chart describing a process for creating a control panel label according to an illustrative embodiment of the present application.

As described above, postage evidencing system 200 enables a user to print virtual stamp indicia images (that may also include the user's custom images), on a mailpiece or a label to be applied to a mailpiece. The following figures describe processes for using the system. Referring to FIG. 9, a flow chart describing a process for creating a control panel label according to an illustrative embodiment of the present application is shown. In step 410, the user connects a VSDM to a collocated PC. The system executes an authentication protocol between the PC and the VSDM. In step 415, the user launches the control panel management tool on the PC. In step 420, the user selects up to three virtual stamp denominations and associates them with the three denomination selection buttons. The user interface will typically only present selections for denominations of virtual stamp tokens that are available in the VSDM.

In step 425, the user selects up to two images from the pc image library and associates them with the two image selection buttons. The images are relatively large so that the image library is stored on the PC and only the selected images are downloaded to the VSDM for use in standalone mode. In the connected mode using the robust user interface through the PC, the user may select any image from the library for use. In step 430, the user creates a new control panel label using the VSDM printer and then installs the new label into the control panel label recess of the VSDM. Accordingly, the VSDM is then ready for standalone virtual stamp printing and may be disconnected from the PC.

Figure 10:
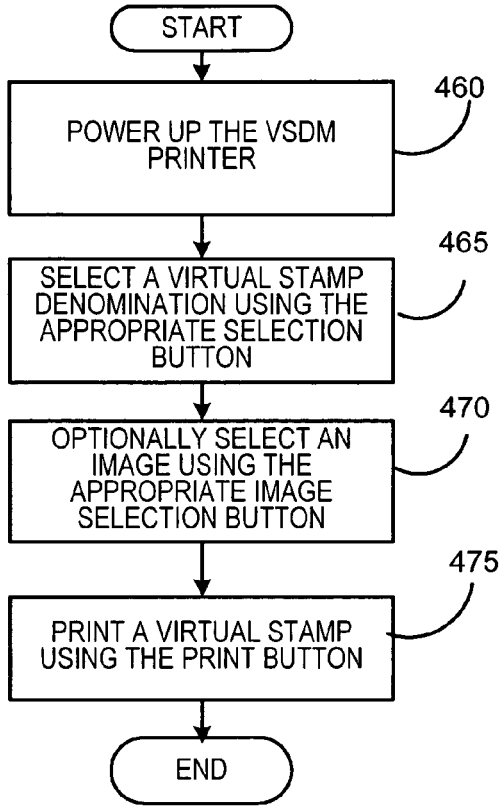
FIG. 10 is a flow chart describing a process for using a virtual stamp printer in standalone mode according to an illustrative embodiment of the present application.

Referring to FIG. 10, a flow chart describing a process for using a virtual stamp printer in standalone mode according to an illustrative embodiment of the present application is shown. In step 460, the user powers up the VSDM. In step 465, the user selects a virtual stamp denomination using the appropriate selection button with reference to the control panel label. In step 470, the user optionally selects an image using the appropriate image selection button. In step 475,the user then prints a virtual stamp by selecting the print button.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. It should be understood that the invention as claimed may be implemented in a number of different mail processing systems, including various known open and closed systems. In addition, the concepts of the present invention are not limited to application in the area of postal indicia printing, but may also be used in connection with the reliable transfer of any type of indication of value in systems, such as, for example, ticketing and digital content delivery rights management. Accordingly, the invention is not to be considered as limited by the foregoing description but is only limited by the scope of the appended claims.

We claim:

1. A virtual stamp dispensing system for printing virtual stamps each having a virtual stamp indicium and a custom image comprising:

a virtual stamp meter including:

a limited button input user interface consisting of a plurality of denomination selection buttons, each of the plurality of denomination buttons associated with a distinct, discrete postage value used for creating the virtual stamp indicium, a plurality of image selection buttons, and a memory for storing one image for each of the plurality of image selection buttons, and a print button;

a printer subsystem printing virtual stamp indicia and images on virtual stamp media stock in response to the selection of one of the plurality of denomination selection buttons, one of the plurality of image selection buttons and then the print button, and;

a control panel including a control panel label recess for receiving a control label having a plurality of printing zones corresponding to the plurality of selection buttons, and;

a collocated processor operatively coupled to the virtual stamp meter including storing in a storage device a library of images including a greater number of images than the number of plurality of image selection buttons, and;

a user interface program including a control panel label creation function receiving button assignments and causing the virtual stamp meter printing subsystem to print a control label on the virtual stamp media stock, wherein the control label includes a plurality of denomination fields each associated with one of the plurality of denomination buttons and a plurality of thumbnail images, each associated with one of the plurality of images associated with one of the plurality of image selection buttons.

2. The virtual stamp dispensing system of claim 1, wherein the media stock is direct contact thermal adhesive label media with backing and the printer subsystem is a direct thermal media printing subsystem.

3. The virtual stamp dispensing system of claim 1, wherein the collocated processor is a personal computer.

4. The virtual stamp dispensing system of claim 1, wherein the control panel label recess includes a plurality of control panel recess tabs for securing the control panel label in place.

5. The virtual stamp dispensing system of claim 1, wherein the control panel includes a hinged window for covering the control panel label recess.

6. The virtual stamp dispensing system of claim 1, wherein the plurality of denomination selection buttons consists of three buttons and the plurality of image selection buttons consists of two buttons.

7. The virtual stamp dispensing system of claim 1, wherein the media stock is label media and the printer subsystem is an ink jet printing subsystem.

8. The virtual stamp dispensing system of claim 1, wherein the control panel label creation function of the user interface program includes a selection window for displaying and receiving selections associated with the subset of the library of images to be assigned to the plurality of image selection buttons.

9. The virtual stamp dispensing system of claim 1, wherein the control panel label creation function of the user interface program includes a selection window for displaying and receiving selections associated with a subset of a library of distinct, discrete postage values to be assigned to the plurality of denomination selection buttons.

* * * * *